United States Patent [19]

Schwob

[11] Patent Number: 4,495,979

[45] Date of Patent: Jan. 29, 1985

[54] ADJUSTABLE WINDOW GRILL

[76] Inventor: Robert J. Schwob, 28 Thurlow Rd., Hampstead, London, England, NW3 5PP

[21] Appl. No.: 570,641

[22] Filed: Jan. 13, 1984

[51] Int. Cl.[3] ..... F06B 3/12

[52] U.S. Cl. ..... 160/226

[58] Field of Search ..... 160/12–17, 160/32, 230, 222–228, 215, 216, 271, 372–375; 98/96, 97, 98, 99, 99 A, 99.1, 99.2

[56] References Cited

U.S. PATENT DOCUMENTS

| | | | |
|---|---|---|---|
| 205,658 | 7/1878 | Lloyd | 160/373 |
| 467,561 | 1/1892 | Rohlen | 160/374 |
| 755,676 | 3/1904 | Kolf | 160/372 |
| 1,136,730 | 4/1915 | Sonntag | 160/374 |
| 2,159,403 | 5/1939 | Rivard | 160/374 |
| 2,201,197 | 5/1940 | Minor, Jr. | 160/222 |
| 2,246,580 | 6/1941 | Farmer | 160/227 |
| 2,295,194 | 9/1942 | Atkinson | 160/225 |
| 4,246,952 | 1/1981 | Melldorfer | 160/271 |

*Primary Examiner*—Peter M. Caun

*Attorney, Agent, or Firm*—Stanley G. Ade

[57] ABSTRACT

An adjustable window grill comprises a first frame member comprising two arms and a base and a second frame member comprising a base and two hollow arms telescopically slidable over the arms of the first frame member. The first frame member has a mesh attached, which extends beyond it and which is received in slots in the inside walls of the arms and the inside and outside walls of the base of the second frame member. A plush fabric is attached to the outer surface of the arms of the first frame.

3 Claims, 8 Drawing Figures

ADJUSTABLE WINDOW GRILL

BACKGROUND OF THE INVENTION

The present invention relates to a grill for fitting into the frame of a sliding window or door to hold the window or door open for admission of fresh air without the risk of insects, animal debris and the like from entering and which is adjustable to fit a range of window frame widths.

Normally, such ventilating grills are of a fixed length and are designed for use in window frames of a specific width. This means that a different window grill has to be produced for each width of window frame.

Alternatively, there is an adjustable sliding type assembly which consists of two rectangular, screened pairs slidably and telescopically engaged with one another and that can be adjusted lengthwise. However, when in place, there is a central area which includes two layers of screen where the two portions overlap and also a pair of vertical frame bars (the inner end bars of each frame portion) which may be close together or spaced apart, depending upon the position of the two portions. Both the double screen section and the frame bars interfere with the visibility through the screen assembly.

SUMMARY OF THE INVENTION

The present invention overcomes these disadvantages by providing a longitudinally adjustable grill for a window comprising a first rigid member including two spaced and parallel arms and base extending between adjacent ends of said arms at one end thereof, a mesh screen spanning said first frame between the arms and base thereof and extending a predetermined amount beyond the open end of said first frame, means for fixing the edges of the screen to the arms and to the base to prevent movement relative thereto, a second frame member comprising a base and two arms, each of the arms comprising a hollow cross section for receiving telescopically slidably therein the arms of the first frame member to complete a variable length of rectangular frame, the cross section being closed except for a slot in the inner surface thereof through which the screen passes, the first frame member having a compressible plush fabric on the outer surface of the arms thereof to engage the respective arm of said second frame member to provide a resistance fit therewith and to extend outwardly from the outer surface of the arm a distance substantially equal to the thickness of the outer surface of the hollow cross section of the second arm.

The construction defined above has a number of advantages. Firstly the simple hollow cross section of the second frame within which the first frame is telescopically slidable allows the second frame to be manufactured such that the transverse thickness thereof is relatively small. This allows the frame as a whole to be received in the slideways of conventional sliding windows. Previous constructions have required much wider frame members which then interfere with the proper fit within such narrow sliding window frames. Of course the frame can also be received in the conventional sash-type windows which slide vertically.

Secondly the plush fabric provides two effects. It provides a resistance fit with the second frame so that the two frames can be slid apart against the resistance fit and then remain fixed at the adjusted position. This allows the frame to be positioned vertically as opposed to the horizontal so that the frame can be inserted either into a horizontally sliding window or a vertically sliding sash-type window. It also compensates for the difference in height between the outer surface of the first frame and the outer surface of the second frame so that when the window closes on the second frame there is not a substantial space which allows the particularly persistant insects to get into the building.

A further advantage of the invention is to provide a device which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF DRAWINGS

In the drawings like characters of reference indicate corresponding parts in the different figures.

DETAILED DESCRIPTION

Figure 1:
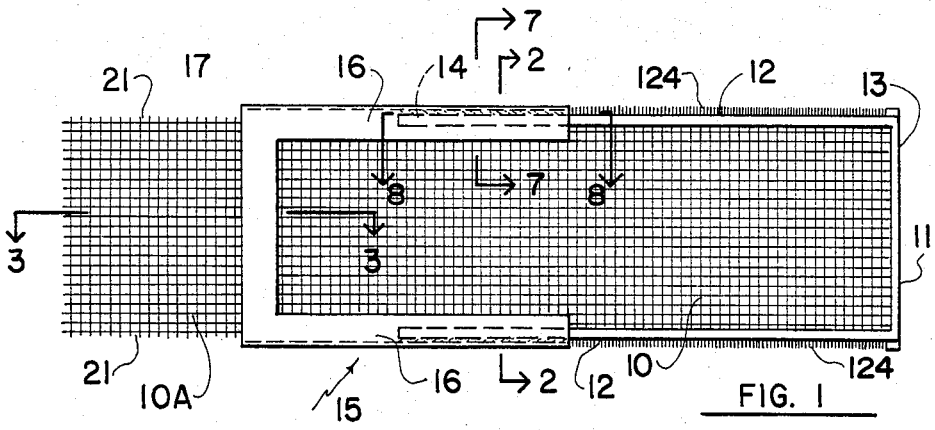
FIG. 1 is a front elevation of the invention.
Figure 2:
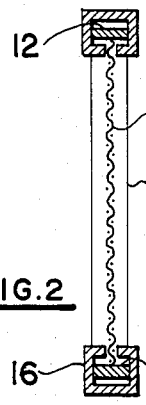
FIG. 2 is a cross sectional view along the line 2—2 of FIG. 1.
Figure 3:
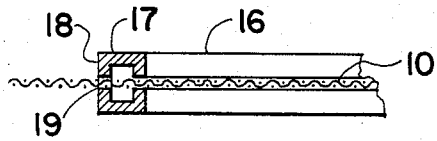
FIG. 3 is a cross sectional view along the line 3—3 of FIG. 1.

Proceeding therefore to describe the invention in detail, a substantially rectangular mesh screen 10 is provided of sufficient length that it will fit the width of any window frame that it may be used in. It is partially enclosed within a frame 11 which is substantially U-shaped and includes a pair of spaced and parallel arms or members 12 and a base 13. The mesh is enclosed within this U-shaped frame by conventional means (not illustrated) and the distal end portion 10A of the rectangular mesh extends beyond the distal ends 14 of the arm 12 by a predetermined amount as clearly shown.

A substantially hollow frame member is provided collectively designated 15 which is also substantially U-shaped and includes a pair of spaced and parallel arms 16 and the base or end portion 17. These are of hollow cross section as shown clearly in the cross sectional views in the drawings and the arms 12 of the first frame 11 slidably engage within the hollow arms 16 for lengthwise adjustment therebetween. In addition the cross section includes a slot 161 along the inner surface thereof through which the screen passes. The base 18 of the end 17 of the frame 15 is also apertured or slotted as at 19 and receives the free or distal end portion 10A of the screen which slides therethrough. This permits the effective area of the screen 10 to be adjusted in length from a minimum length when the frame 15 is fully engaged with the frame 12, to a maximum when the frames are as far apart as possible. To prevent them separating one from the other, cooperating notches 23, 24 are provided respectively on the inner face of the arms 16 and on the outer face of the arms 12.

Once adjusted within the window sash 20, the surplus portion of the free end 10A of the screen may be cut off flush with the base 18 of the frame 15.

Figure 7:
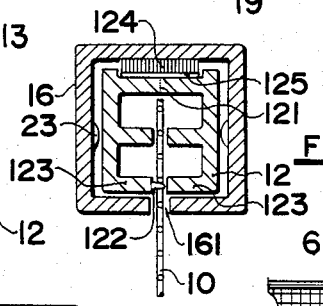
FIG. 7 is a cross section along the line 7—7 of FIG. 1 showing a modified cross section of the first arms.

Turning now to FIG. 7 there is shown in more detail a preferred cross section for the outer or second arm 16 and for the inner arm 12. The outer arm comprises merely a simple closed hollow body with a slot 161 in the inner side thereof of sufficient width merely to receive the screen. The arm can be formed from a molded plastic material and hence is relatively thin and of lightweight. It can also be formed in two halves and welded together at 162 using an ultrasonic welding technique.

The arm 12 is also formed in two halves each of which is of E-shaped cross section welded at 121 and having projections 122 at the bottom leg of the E for clamping the screen between the bottom legs indicated at 123. The upper or outer surface of the arm carries a plush fabric 124 on a foam base 125 so that the fabric extends upwardly and contacts the lower surface of the upper side of the arm 16.

Figure 4:
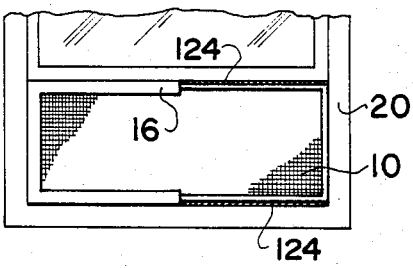
FIG. 4 is a fragmentary front elevation of a window with the invention installed therein.

The plush fabric is bent over by contact with the arm 16 and hence provides a resistance fit between the two arms to hold the frame in the position to which it is extended. Thus the frame can be positioned vertically without collapsing and without the necessity for further locking means. In addition the plush fabric when it is outside the arm 16 extends straight upwards and hence reaches a height substantially equal to the outer surface of the arm 16 so that when received in a window frame it bridges the gap as shown in FIG. 4.

Figure 5:
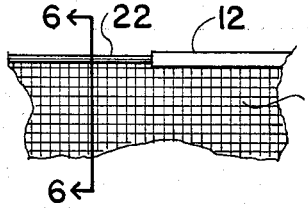
FIG. 5 is a fragmentary view of the distal end of one arm of the frame carrying the mesh showing a reinforcing bead on the free edge of the mesh.
Figure 8:
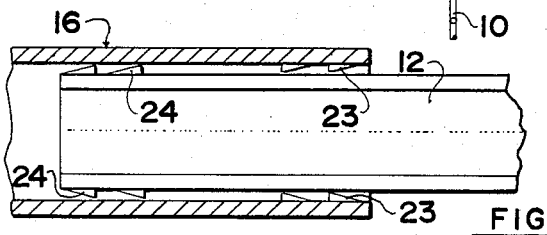
FIG. 8 is a cross section along the line 8—8 of FIG. 1.
Figure 6:
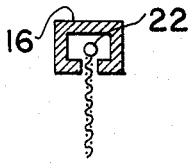
FIG. 6 is a fragmentary cross sectional view along the line 6—6 of FIG. 5.

Although the screen is preferably sufficiently rigid so that it stands across the arms 16 beyond the ends of the arms 12 without collapsing through the slots 161, FIGS. 5 and 6 show an alternative embodiment in which the edges 21 of the free portion 10A of the screen may be provided with a bead 22 for reinforcing purposes and this bead 22 of course slides within the hollow arms 16 as shown in FIG. 6.

Since various modifications can be made in my invention as hereinabove described, and many apparently widely different embodiments of the same made within the spirit and scope of the claims without departing from such spirit and scope, it is intended that all matter contained in the accompanying specification shall be interpreted as illustrative only and not in a limiting sense.

I claim:

1. A longitudinally adjustable grill for a window comprising a first rigid frame member including two spaced and parallel arms and base extending between adjacent ends of said arms at one end thereof, a mesh screen spanning said first frame between the arms and base thereof and extending a predetermined amount beyond the open end of said first frame, means for fixing the edges of the screen to the arms and to the base to prevent movement relative thereto, a second frame member comprising a base and two arms, each of the arms comprising a hollow cross section for receiving telescopically slidably therein the arms of the first frame member to complete a variable length of rectangular frame, the cross section being closed except for a slot in the inner surface thereof through which the screen passes, the first frame member having a compressible plush fabric on the outer surface of the arms thereof to engage the respective arm of said second frame member to provide a resistance fit therewith and to extend outwardly from the outer surface of the arm a distance substantially equal to the thickness of the outer surface of the hollow cross section of the second arm.

2. An adjustable grill according to claim 1 in which the base of the second frame member is hollow and is provided with a first slot continuous with the slots in the arms of said second frame member and a second slot in the wall opposite the said first slot, and in which the mesh extends beyond the first frame member so that the extending portion can be slidably received in the said first and second slots in the base of the second frame member to enable the mesh to be tautly held in the rectangular frame.

3. An adjustable grill according to claim 1 or 2 in which the edges of the portion of the screen extending beyond said open end of said first frame includes a stiffening bead secured thereto.

* * * * *